US008297432B2

(12) United States Patent
Stauber

(10) Patent No.: US 8,297,432 B2
(45) Date of Patent: Oct. 30, 2012

(54) METHOD AND DEVICE FOR CONVEYING PLANAR PRODUCTS

(75) Inventor: Ulrich H. Stauber, Grut (CH)

(73) Assignee: Ferag AG, Hinwil (CH)

( * ) Notice: Subject to any disclaimer, the term of this patent is extended or adjusted under 35 U.S.C. 154(b) by 120 days.

(21) Appl. No.: 12/864,270

(22) PCT Filed: Jan. 20, 2009

(86) PCT No.: PCT/CH2009/000022

§ 371 (c)(1),
(2), (4) Date: Jul. 23, 2010

(87) PCT Pub. No.: WO2009/092175

PCT Pub. Date: Jul. 30, 2009

(65) Prior Publication Data

US 2010/0326795 A1 Dec. 30, 2010

(30) Foreign Application Priority Data

Jan. 24, 2008 (CH) ..... 0098/08

(51) Int. Cl.
*B65G 47/84* (2006.01)

(52) U.S. Cl. ..... 198/470.1; 198/478.1; 198/483.1; 271/187

(58) Field of Classification Search ..... 198/470.1, 198/478.1, 477.1, 483.1; 271/187, 315, 82
See application file for complete search history.

(56) References Cited

U.S. PATENT DOCUMENTS

| | | | | |
|---|---|---|---|---|
| 4,434,979 | A * | 3/1984 | Kobler et al. | 271/307 |
| 6,672,447 | B2 * | 1/2004 | Muller | 198/478.1 |
| 6,851,544 | B2 * | 2/2005 | Noll, Jr. | 198/470.1 |
| 2003/0021659 | A1 * | 1/2003 | Michler | 414/315 |

FOREIGN PATENT DOCUMENTS

| | | |
|---|---|---|
| EP | 0 265 735 | 5/1988 |
| EP | 0 309 702 | 4/1989 |
| EP | 0 346 578 | 12/1989 |
| EP | 0 568 883 | 11/1993 |
| EP | 0854105 | 7/1998 |

* cited by examiner

*Primary Examiner* — James R Bidwell
(74) *Attorney, Agent, or Firm* — Rankin, Hill & Clark LLP

(57) ABSTRACT

A method and to a device for conveying planar products (12), particularly folded printed products. At a transfer point (A), the products (12) are inserted with the leading edges (14) thereof ahead into compartments (22) of a revolving system (20) in the form of a paddle wheel, the compartments moving along a closed revolving path (U), and removed from the compartments (22) at a transfer point (B) by way of grippers (32) of a gripper conveyor (30) and conveyed away. The products are seized by the grippers (32) at the trailing edges (16). The seizing of the trailing edge (16), which preferably is not the folded open product edge, has the advantage that it can be implemented without a complicated engagement of the revolving system (20) and gripper conveyor (30) and that the further conveyance and further processing of the products (12) are simplified.

17 Claims, 3 Drawing Sheets

METHOD AND DEVICE FOR CONVEYING PLANAR PRODUCTS

BACKGROUND OF THE INVENTION

1. Field of the Invention

The invention covers the field of conveying technology and is concerned, in particular, with conveying printed products.

2. Description of Related Art

Apparatuses in the form of paddle wheels for transferring sheet-like products are generally known. They are used, for example in printing technology, to receive folded printed products coming from a rotary printing machine, or from the folding unit thereof, and to deliver them in imbricated form onto delivery belts arranged beneath the paddle wheel. The resulting imbricated formation can then be fed for further processing.

The products are fed to the paddle wheel usually from above or from the side, with the folding edge in front, and are discharged again approximately after a half revolution of the wheel, with the assistance of gravitational force, at the lowermost point of the path. A fixed-location stripping device is usually present in order to assist this process, the stripping device acting on the leading edge (folding edge) and pushing the product out of the compartment as the wheel rotates further.

In order for a constant imbrication spacing to be produced on the delivery belt, it is desirable for the movement of the product to be well-controlled as the products exit from the paddle wheel.

In order for a regular imbrication spacing to be produced, it is known, for example from EP-A 0 739 840, EP-A 1 510 488 or WO 98/16455, for controlled grippers to grip the printed products in the lower part of the movement path, shortly before they exit from the compartments of the paddle wheel, at their edge which rests on the base of the compartments (compartment base), i.e. at the leading edge, as seen in respect of the formation of products entering the paddle wheel. The grippers here also perform the function of the aforementioned stripper. The printed products secured by the grippers are removed from the paddle-wheel compartments on account of the movement of the gripper and paddle-wheel compartment relative to one another. Since the grippers accompany the compartments, or compartment bases, some way, the products are moved, and conveyed further, at the receiving location in the direction of circulation of the paddle wheel. The products are then deposited in imbricated form from above on a removal conveyor or transferred to a further gripper conveyor. The imbricated formation produced is one in which the leading edges—as in the original formation—are arranged upstream of the trailing edges. Since the grippers only act on the products in the lower part of the movement path of the paddle wheel, there is a risk of the products sliding out of the compartments in an uncontrolled manner, on account of gravitational force, before being gripped. This can also give rise to irregularities in the formation produced.

In order for it to be possible, in the case of such apparatuses, for the grippers to act on the leading edge, which is located in the region of the compartment base, the movement path of the grippers is located well within the paddle wheel, as seen in a plan view of the axis of rotation of the paddle wheel. The products are guided out of the compartments in the downward direction and conveyed further by the gripper conveyor beneath the paddle wheel and/or deposited, with the assistance of gravitational force, on a conveying belt arranged beneath the paddle wheel. This requires the apparatus as a whole (paddle wheel and conveying belt arranged therebeneath) to be of a certain minimal overall height. As seen in a projection of the axis of rotation of the paddle wheel, the circulatory path of the grippers, and of the drive means thereof, is located, at least in part, within the surface area of the paddle wheel. The gripper conveyor has to engage in the paddle wheel, which is mechanically complex.

A further disadvantage resides in the fact that the leading edge is gripped. At the exit of a rotary printing machine, the leading edge is usually the folding edge of the product. It is precisely in the case of relatively thick or multi-part printed products, prior to stitching or stapling, that gripping of the folding edge can result in product parts falling out. Moreover, the product, for the purpose of further processing, often has to be introduced into a further-processing station with the folding edge in front, e.g. it has to be introduced into an insertion or cutting drum in order for further products to be inserted or for the edge located opposite the folding edge to be cut. In such cases, therefore, engagement around the product is necessary, and this requires transfer to a further gripper conveyor or depositing and regripping operations. The additional component which is necessary for engaging around the product renders this practice complex and expensive.

ER-A 0 265 735 discloses the practice of evening out the products, in order to produce a constant imbrication spacing, by action on their trailing edges once they have been removed from the compartments. For this purpose, a conveying belt with an auxiliary conveyor is arranged beneath the paddle wheel, and this auxiliary conveyor moves in the same direction as the direction of circulation at the receiving location. The auxiliary conveyor has a plurality of clamping elements. The products are pushed out of the compartments of the paddle wheel in the downward direction on account of gravitational force, and with the assistance of strippers acting on the leading edges, and end up located in an imbricated formation on the conveying belt. The clamping elements serve as a stop for the trailing edges of the already deposited products and clamp the same firmly against the conveying belt. They thus ensure a constant spacing of the trailing edges on the conveying belt. Once the product has been evened out in this way, the clamping elements are removed and the products are conveyed further in the evened-out imbricated formation.

As in the case in the above described apparatuses, there is the disadvantage here that the products can slide out of the compartments in an uncontrolled manner. For this reason, the known apparatus has guide elements for the products, e.g. lateral directing plates or supporting belts, which are intended to support, in particular, the trailing edges. It is, thus, not possible to prevent slipping of product parts, for example of different formats, within a product. Moreover, the conveying belt moves in the same direction as the paddle wheel in its lower region. It is, thus, also the case here that the role of the leading and trailing edges in the exiting formation remains unchanged in relation to the original formation.

It is, thus, an object of the invention to reduce the disadvantages described above. In particular, the intention is to provide a method and an apparatus which make it possible for products, in particular folded printed products, to be transferred in a well-controlled and reliable manner between a paddle wheel and a further conveying device.

BRIEF SUMMARY OF THE INVENTION

The method according to the invention and the apparatus according to the invention, both for conveying sheet-like products, in particular printed products, proceed from the fact that the products are introduced into compartments of a circulating system, these compartments moving along a closed circulatory path, at a transfer location in a manner known per se, with their leading edge in front. The circulating system is a paddle wheel like that in the prior art cited above. The products are fed preferably in a feed direction which corresponds to the orientation of the compartments as they pass the transfer location. Since compartment bases are spaced apart from the axis of rotation of the paddle wheel and the compartments are open in a direction other than the radial direction, pronounced acceleration and changes in direction of the product during transfer are avoided and the products are therefore treated very carefully. The leading edge is usually—but not necessarily—a folding edge of a printed product. If the product is folded a number of times, the leading edge is, in particular, the final folding edge. The products are conveyed further, by way of their compartments, to a receiving location, for example by rotation of the paddle wheel. Individually fed products. here are usually braked in comparison with the conveying speed of the feed conveyor by being rearranged into a more compact formation as they are introduced into the circulating system. If they have been fed already in a compact formation, e.g. an imbricated formation or in small stacks, they are usually separated as they are introduced into the compartments. Following passage through part of the circulatory path of the compartments, e.g. following rotation of the paddle wheel through 60 to 180°, the products are received at the receiving location by grippers of a gripper conveyor and are conveyed away by the same. According to the invention, the trailing edge is gripped here. The products are preferably oriented here such that the trailing edge is located above the leading edge, that is to say the product is supported, on account of gravitational force, on the compartment base and thus assumes a well-defined position prior to, and as it is, being received. As a result of the movement of the compartment and gripper relative to one another, the product is released from the circulating system and can be conveyed further by the gripper conveyor.

The practice of gripping the trailing edge, which is preferably a non-folded, open product edge, has the advantage that it can be realized in a space-saving manner, which is straightforward in design terms, without any complicated interengagement of the circulating system and gripper conveyor. The grippers can act, in particular in the immediate vicinity of the compartment openings, on the trailing edge of the product arranged in the respective compartment, in which case the products are optimally supported by the compartment wall until being gripped. For adaptation to various formats, the compartment bases or a stripper which is preferably present, and acts on the leading edge butting against the compartment base, may be adjustable, in which case the receiving operation can take place always at the same location.

The practice of gripping the trailing edge has the additional advantage of, in particular, folded printed products being moved into a position which is optimal for further processing. They can be introduced into an insertion or cutting drum for example with the folding edge in front, in which case the open edge ("bloom"), which is located opposite the folding edge, can be processed. A further advantage resides in the fact that gripping of the product at the open edge means that it is not possible for any constituent parts of the product to fall out.

Finally, the fact that the products are present within the circulating system, usually already in a separated state, is utilized in order for them to be conveyed further, and processed further, individually by way of the gripper conveyor. If required, it is also possible for two or more products to be introduced into one compartment and into one gripper.

The invention has the further advantage that it is possible to compensate for timing inaccuracies in the fed formation which have not already been compensated for by the circulating system or which arise within the circulating system. This is because the grippers are conveyed preferably at a constant spacing and grip the products always at the same location, while the latter are still essentially fully supported by the compartments and are, thus, positioned in a very well-controllable manner.

Paddle wheel is understood as being any conveyor with a plurality of compartments which move along a circular path and into which the products are inserted without necessarily being actively fixed. Active fixing (e.g. clamping), however, is possible. The paddle wheel, for example, is a rotary body which has one or more compartments or pockets which can receive products and convey them along a circular path as a result of the rotary body being rotated above an axis of rotation. The aforementioned paddle wheels (star wheels) can usually be rotated about a horizontal axis. The compartment base is spaced apart from the axis of rotation by a certain spacing r which is greater than zero, in order for it to be possible for the products to be pushed out of the compartments, in dependence on the rotary position, by action on the leading edges. The compartments open at an angle relative to the radial direction, counter to the direction of circulation, in which case the leading edge of the products is located upstream of the trailing edge, as seen in the direction of circulation of the paddle wheel. The compartments are located, for example, one above the other in an imbricated manner in cross section, in order to achieve the greatest possible conveying capacity. These observations are also transferrable to differently configured circulating systems. The compartments are fastened for example, to conveying means, e.g. a chain or a cable, and are moved by a drive along the circulatory path at a constant or variable spacing. It is preferred, but not necessary, for the circulatory path of the circulating system to be located in a vertical plane.

In an advantageous variant of the invention, the leading edge of a product, during conveying through the circulating system, at least until the product is gripped, is located beneath the trailing edge of the product. This has the advantage that the position of the leading edge, on account of gravitational force, is defined at any point in time by the position of the compartment base or of a stripper which may be present. The situation where the product slides out of the compartment or is displaced within the compartment on account of the gravitational force is prevented. A defined position of the leading edge means that the position of the trailing edge is also well defined at any point in time of the movement operation. The trailing edges are gripped directly, in this defined position, by the grippers, which, for this purpose, are located in particular above, or to the side of, the circulating system and approach the same from above. The conveying direction and speed of the gripper conveyor are adapted to the conveying direction and speed of the circulating system. After the product has been gripped, the leading edge may also be located above the trailing edge, since the product position is then well defined by the gripper.

The products are introduced into the compartments in a state ranging from preferably essentially horizontal (trailing edge directed toward the feed means) to upright (trailing edge at the top). When they are gripped at the receiving location, the products are located in a position ranging from upright (trailing edge at the top) to approximately horizontal (trailing edge directed toward the gripper). The above described orientation of the leading and trailing edges means that there is no need for any additional elements in order to fix the products in the compartments.

In order to achieve the described orientations of the product, the conveyor for feeding the products and the gripper conveyor for conveying the products away are arranged such that the products are transferred, and respectively received, at a point in time after, or respectively before, the compartments are inclined such that the leading edge (or a point on the compartment base) would be located beneath the trailing edge (or a point in the opening region of the compartment). The transfer location is located, for this purpose, preferably in an upper region of the circulating system. The receiving location is located, for this purpose, usually vertically beneath the transfer location. The receiving location is located preferably laterally alongside the circulating system, as seen in the plan view of the axis of rotation. This also has the advantage of a low overall height, and a more straightforward design, of the apparatus, since the movement paths of the compartments (or the opening regions thereof) and of the grippers have to overlap only to a slight extent, if at all.

The transfer location, i.e. the location at which the products are transferred to the compartments of the circulating system, and the receiving location are preferably arranged, and the compartments are preferably formed, such that the horizontal position of the leading edge and of the trailing edge is swapped over between the transfer location and receiving location by the movement of the compartments along the circulatory path of the circulating system. That is to say that, as seen from the receiving location, the leading edge is located horizontally upstream of the trailing edge at the transfer location and in the region of, or downstream of, the trailing edge at the receiving location. The product executes a kind of switchback turn during conveying. This easily makes it possible without any great acceleration, and thus without the products being adversely affected, to produce formations in which the (originally) trailing edge is leading, as seen in the conveying direction of the gripper conveyor, and/or in which the products are arranged in a hanging, and thus spatially compact, state. This has advantages, as explained in the introduction, for the further processing of the products. It also gives rise to better accuracy in the exit formation since the compartment base acts as a stop and the opposing edge (trailing edge) is gripped. This is more precise than the operations of gripping the edge butting against the compartment base and of conveying away in the direction of circulation of the compartment.

The products can be conveyed to the circulating system, for transfer to the circulating system, individually, in an imbricated formation and/or in small stacks. The products come, for example, directly from a rotary printing machine, from an interim store (e.g. product roll) or from some other upstream process.

The operation of the product being received by the grippers is preferably assisted in that the products are displaced relative to the compartment, counter to gravitational force, e.g. by action on the leading edges by means of a stripping device, in which case they project a little way out of the compartment and can be gripped more easily. For a product position which is stable at all points in time, the amount by which the products project out of the compartment, preferably in relation to the overall length of the product, is small, particularly preferably smaller than a quarter, to smaller than a tenth, of the overall length of the product. The stripping device can be displaced preferably for adaptation to different product formats, in order to achieve the situation where the trailing edge, despite different product lengths, is always located in the same position in the region of the receiving location.

A monitoring device preferably serves for monitoring the formation of products which is fed to the circulating system, in particular for determining irregularities or defective products. This monitoring device may be, for example, an optical sensor. The monitoring device communicates with a control device by emitting a corresponding signal, for example when a product arrives or in the presence of an irregularity or of a defective product. The control device uses this signal to control the movement of the circulating system and/or of the gripper conveyor and/or of the gripper, in particular with the aim of compensating for defects and irregularities in the exiting formation produced by the gripper conveyor. For example, when each product arrives, the monitoring device emits a clock signal to the control device, and this signal serves for controlling the circulatory movement of the circulating system and of the gripper conveyor. In another variant, the circulating system and gripper conveyor are driven synchronously in the customary manner, but the circulatory speed, on account of a signal from the monitoring device, is adapted in a controlled manner in order to compensate for, for example, gaps (e.g. brief standstill period). In a further variant, the grippers are activated individually in order for, for example, defective products to be specifically deflected rather than picked up. A corresponding method has already been described in Swiss Patent Application No. 1806/07, which was not published before the priority date and to which reference is made here. In all cases, the control device is connected in control terms to the drive of the circulating system and/or of the gripper conveyor and/or of any controllable guide tracks, and can transmit signals to these components.

BRIEF DESCRIPTION OF THE DRAWINGS

Examples of the invention will be described hereinbelow and are illustrated in the drawings, in which, purely schematically.

DETAILED DESCRIPTION OF THE INVENTION

Figure 1:
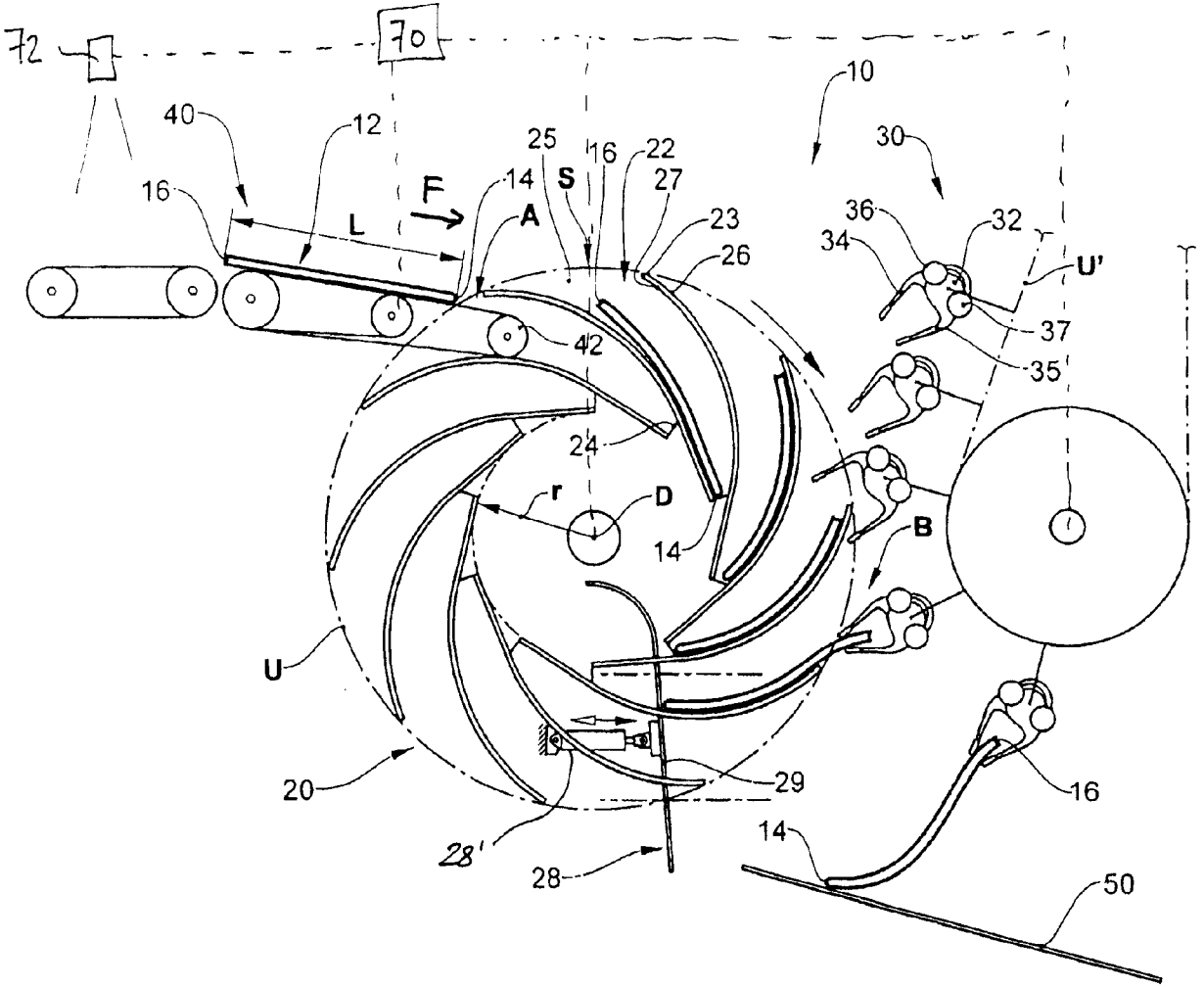
FIG. 1 shows an apparatus according to the invention with a paddle wheel as the circulating system, as seen in a side view of the axis of rotation of the paddle wheel, during processing of products of a first format.

FIG. 1 shows, schematically, an apparatus 10 according to the invention with a paddle wheel 20 as the circulating system, with a gripper conveyor 30 and with a feed conveyor 40, as seen in a projection of the axis of rotation D of the paddle wheel 20.

The paddle wheel 20 has a plurality of compartments 22 which are defined by supporting/separating elements 23 which are curved slightly convexly relative to the axis of rotation D. The separating elements 23 wind around the axis of rotation D in the manner of a very elongate helix. The walls 26, 27 of a compartment 22 are defined by the facing surfaces of two adjacent separating elements 23. The separating elements 23 run toward one another and in this way, and/or by way of a connecting piece, define the compartment base 24. The compartment bases 24 are spaced apart from the axis of rotation D approximately at a constant spacing r. The compartments 22 open counter to the direction of rotation of the paddle wheel, which in this case rotates in the clockwise direction. Located in the region of the lower half of the paddle wheel 20 is a horizontally displaceable stripping device 28 which does not circulate along with the paddle wheel and has a guide surface 29 which is curved in the upper region and, for the rest, is oriented approximately vertically. The stripping device 28 can be displaced in the horizontal direction by means of a suitable drive 28'.

The feed conveyor 40 here is a belt conveyor, which has the products 12 resting individually on its conveying belt. It is likewise possible for small stacks or an imbricated formation to be fed by the feed conveyor. The front region 42 of the feed conveyor 40 projects into the paddle wheel 20. For this purpose, the feed conveyor 40 and/or the separating elements 23 are/is of interrogating configuration. The location at which the products 12 are introduced into the compartments 22 is denoted as transfer region A. The transfer region A is located just upstream, as seen in the direction of rotation, of the upper vertex S of the movement path U of the compartments 22, approximately at the "11-o-clock" position. U is used here to denote, by way of example, the movement path of a radially outer point on the separating elements 23. The feed direction F is predetermined by the orientation of the belt conveyor. The orientation of the compartments 22 (e.g. orientation of the trailing compartment wall 26) corresponds, in the transfer region A, approximately to the feed direction F.

The gripper conveyor 30 has a plurality of individually controllable grippers 32 which are moved along a closed circulatory path U'. U' is used here to denote, for example, the movement path of drive means (not illustrated specifically here) to which the grippers 32 are connected. The grippers 32 can be pivoted relative to the circulatory path U' in a manner known per se by means of suitable guide tracks. It is likewise possible for the position of the two gripper jaws 34, 35, e.g. open or closed gripper mouth, to be set using suitable guide tracks. The gripper 32, for this purpose, has control elements 36, 37 in the form of control rollers, which interact with the aforementioned guide tracks in order for the gripper 32 to be closed, opened and/or pivoted. The region in which the grippers 32 are closed is also denoted as receiving location B. The receiving location B is located to the side of the paddle wheel 20, approximately at the "3-o-clock" position. It is located vertically beneath the transfer location A.

A supporting surface 50 is located beneath the gripper conveyor 30.

The function of the apparatus will be described hereinbelow: at the transfer location A, the products 12 of product length L, as measured between the leading edge 14 and trailing edge 16, are introduced into the compartments 22 with their leading edge 14 in front, in which case the leading edge 14 is located in the region of the compartment base 24 and the trailing edge 16 is located in the region of the compartment opening 25. The compartments 22 are oriented in the region of the transfer location A such that the compartment base 24 is located beneath the front end 42 of the feed conveyor 40. The spacing r from the axis of rotation means that the compartment base 24, as the product 12 is being received in the compartment 22, and after it has been received therein, moves initially with a movement component in the original conveying direction F. The product 12, immediately after having been introduced into the compartment 22, is thus moved further essentially in its original conveying direction F, and it is only as the paddle wheel rotates further that it is subjected gently to a change in direction. Pronounced acceleration is thus avoided.

As they are conveyed further in the compartments 22, the products 12 butt, in the first instance, against the trailing compartment wall 26, as seen in the direction of revolution, and, as movement progresses, against the leading compartment wall 27, as seen in the direction of revolution. In this position, they reach the receiving location B. The position of the latter is selected such that the leading edges 14, at least until the products 12 are gripped by the grippers 32, are located beneath the trailing edges 16. In other words, the compartments 22 are oriented between the transfer location A and receiving location B such that the compartment bases 24 are located beneath the compartment openings 25. The grippers 32 are moved in an open state to the receiving location B and are closed there. As they approach the receiving location B, they can engage slightly, by way of their gripper jaws 34, 35, between the compartment walls 26, 27, and this allows them to be closed together as they approach. However, the actual receiving operation by virtue of the gripper 32 being closed takes place, in the present example, outside the circulatory path U and/or outside the surface area which is covered over by the paddle wheel 20, as seen in a plan view of the axis of rotation D thereof. There is therefore no need for the compartment walls 26, 27 to have any recesses for engagement of the grippers 32. The stripping device 28 serves to push the products 12 a little way out of the compartment, counter to gravitational force, by action on the leading edges 14, which are initially located on the compartment base 24, and this means that the trailing edges 16 are moved into the region of the grippers 32, or of the distal ends of the gripper jaws 34, 35 and can be gripped securely there. The products 12 are, thus, in a well-defined position at any point in time during the movement operation.

Once gripped, the products 12 are drawn out of the compartments, and conveyed further, by the gripper conveyor 30. It is possible here to produce a spatially very compact formation made up of separated products 12 conveyed in a hanging state one beside the other. At least immediately following gripping, the trailing edge 16 is located upstream of the leading edge 14, as seen in the conveying direction of the gripper conveyor 30. The roles of the leading and trailing edges 14, 16 have thus been swapped over in relation to the original formation.

It is also possible, as shown here schematically, for the products 12 to be supported at the hanging-down (originally) leading edge 14 by a supporting surface 50. The supporting surface 50 may also be the conveying belt of a further belt conveyor, on which the products can then also be deposited in their entirety. This makes it possible for the products to be carefully rearranged (leading edge becomes the trailing edge, and vice versa). This is shown by way of example in FIG. 3.

The control device 70 serves for synchronizing the movement of the feed conveyor 40, circulating system 20 and gripper conveyor 30. It optionally receives, from a monitoring device 72 a signal which serves for adapting the movements of these components in the manner mentioned in the general part of the description. It is thus possible to compensate for irregularities or to eject defective products.

Figure 2:
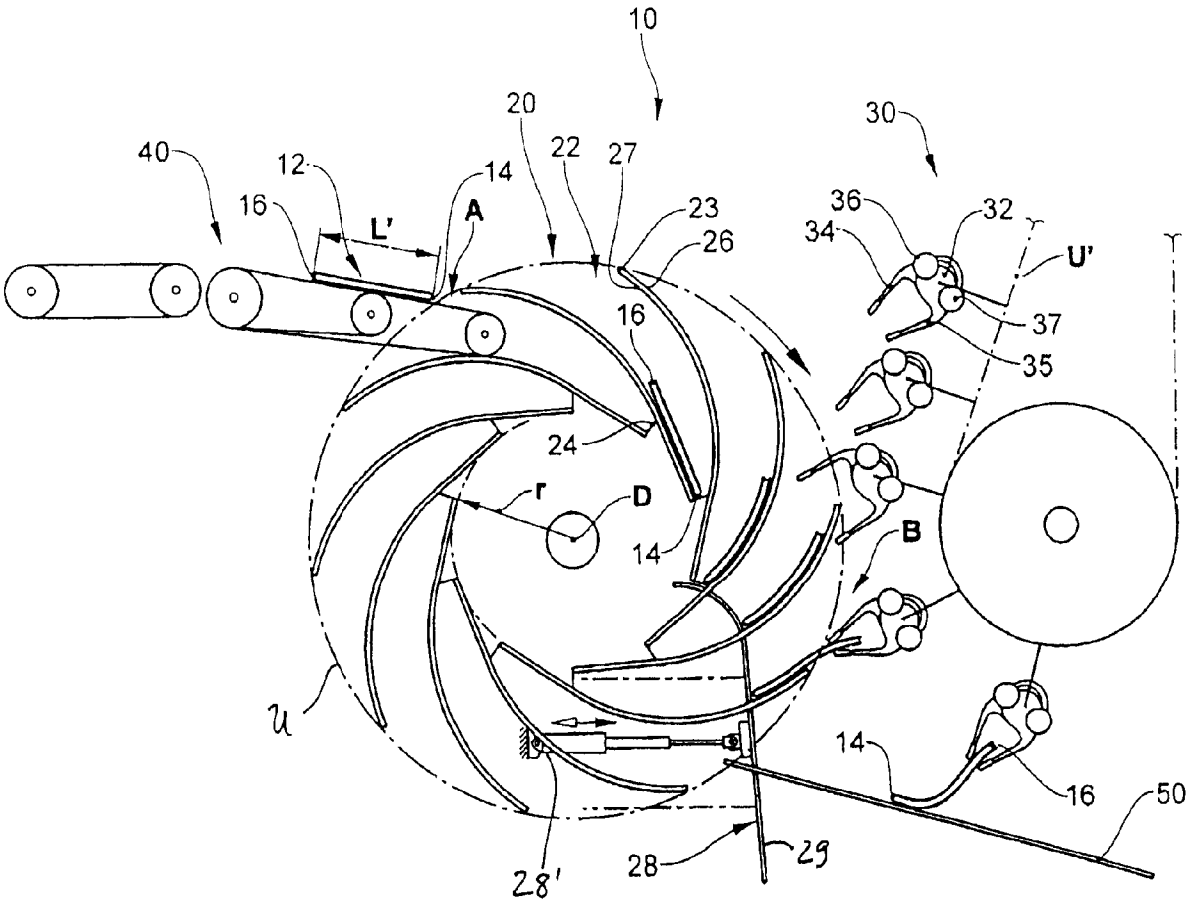
FIG. 2 shows the apparatus from FIG. 1 during processing of products of a smaller, second format.

FIG. 2 shows the apparatus from FIG. 1 during processing of products 12 of a product length L', which is smaller than the product length L of the products from FIG. 1. These products 12 likewise end up located with their leading edge 14 on the compartment base 24. The shorter product length L' means that the trailing edge 16 is positioned further into the compartment 22. The stripping device 28 can be displaced in a horizontal direction in order to compensate for the differences in length of the products 12 such that the operation of the products being received by the grippers 32 can take place at always the same position.

Figure 3:
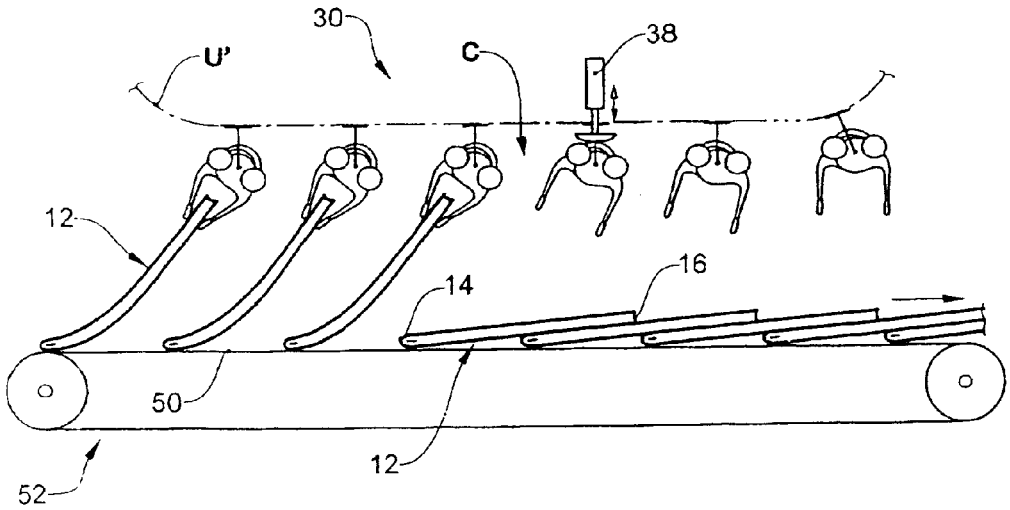
FIG. 3 shows the operations of folded products being conveyed by the gripper conveyor and transferred to a belt conveyor.

FIG. 3 shows the transfer of the products 12 to a belt conveyor 52, of which the conveying belt constitutes the aforementioned supporting surface 50. The latter moves in the same direction as the grippers 32 of the gripper conveyor 30 arranged above. The products 12 are conveyed in a hanging position downstream of the receiving location B, wherein the (originally) leading edge 14 rests on the supporting surface 50 and is arranged downstream of the gripped (originally) trailing edge 16, as seen in the conveying direction of the gripper conveyor 30. A triggering element 38 opens the grippers 32 at a discharge location C. This results in an imbricated formation in which the open (originally) trailing edges 16 are leading, and rest on the preceding product 12, being produced on the conveying belt.

The removal of the products 12 from the paddle wheel 20 by way of grippers 32 gives rise to a precisely timed imbricated formation as the products are being received and, consequently, also as they are deposited.

Figure 4:
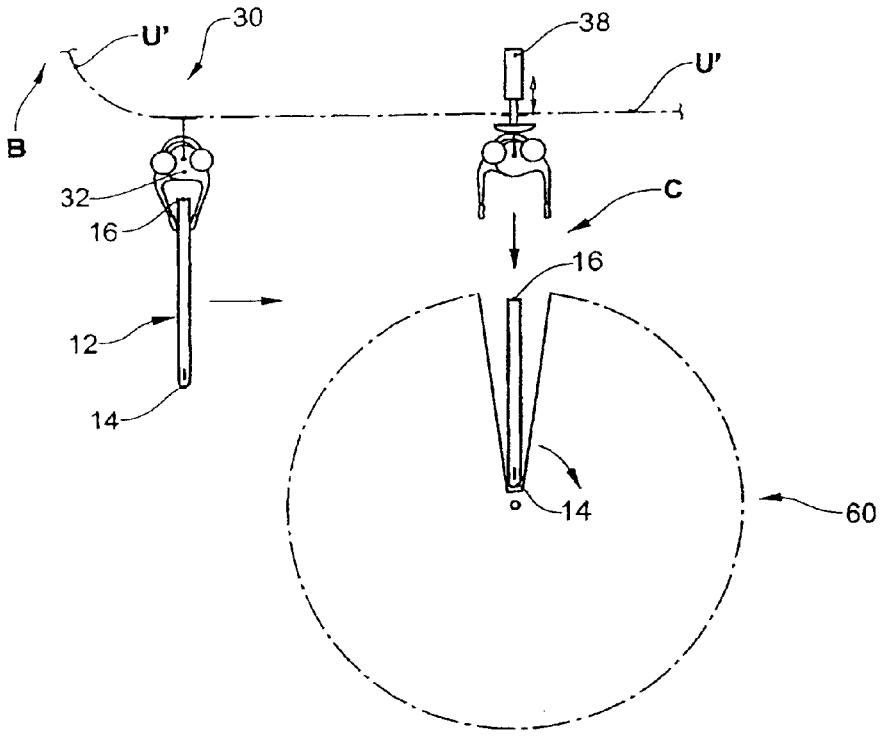
FIG. 4 shows the operations of folded products being conveyed by the gripper conveyor and processed further in an insertion or cutting apparatus.

FIG. 4 shows the transfer of the products 12 from the gripper conveyor 30 to an insertion or cutting drum 60. The grippers 32 are opened by a triggering element 38 at a discharge location C, in which case the products 12 fall downward into compartments of the insertion or cutting drum 60. The folded open (originally) leading edge 14 is located on the compartment base and the (originally) trailing edge 16 is located in the region of the opening of the compartment, and thus in the correct position for the cutting operation. It is thus possible, using little outlay, to achieve the correct product position in order for it to be possible for the desired processing to be carried out.

The invention claimed is:

1. A method of conveying sheet-like products, in particular printed products, comprising the steps of:

introducing the products at a transfer location (A), with their leading edge in front, into compartments moving along a closed circulatory path (U) of a circulating system, and removing the products from the compartments, and conveying the products away, at a receiving location (B) by means of grippers of a gripper conveyor, wherein the circulating system is a paddle wheel which can be rotated about an axis of rotation (D), wherein the compartments have compartment bases spaced apart from the axis of rotation, and wherein the compartments open opposite to the direction of circulation at an angle relative to the radial direction, so that the leading edge of the products seen in the direction of circulation of the paddle wheel is located upstream of the trailing edge, and wherein the leading edge of a product during conveying between the transfer location (a) and the receiving location (b), at least until the product is gripped, is located beneath the trailing edge of the product, and wherein the products are gripped at their trailing edge by the grippers.

2. The method as claimed in claim 1, wherein the grippers act from the outside on the trailing edge of the product arranged in the respective compartment, in the region of compartment openings.

3. The method as claimed in claim 1, wherein the leading edge of a product during conveying between the transfer location (A) and the receiving location (B), at least until the product is gripped, is located beneath the trailing edge of the product.

4. The method as claimed in claim 1, wherein the grippers convey the products such that the trailing edge of a product, at least immediately after the product has been received, is located upstream of the leading edge of the product, as seen in the conveying direction of the gripper conveyor.

5. The method as claimed in claim 1, wherein the products, prior to being received by the grippers, are pushed out of the compartments, counter to gravitational force, such that the trailing edges can be gripped by the grippers.

6. The method as claimed in claim 5, wherein the products are pushed out of the compartments by action on their leading edges.

7. The method as claimed in claim 5, wherein the products, prior to being received by the grippers, are pushed out of the compartments by a predetermined amount which is smaller than a quarter of the overall length (L, L') of the product.

8. The method as claimed in claim 1, wherein the gripper conveyor receives the products to the side of the circulating system and outside the circulating system, as seen in a plan view of the movement plane of the circulating system.

9. The method as claimed in claim 1, wherein the products are conveyed to the circulating system individually, in an imbricated formation and/or in small stacks.

10. The method as claimed in claim 1, wherein the formation of products which is fed to the circulating system is monitored by means of a monitoring device, and the movement of the circulating system or of the gripper conveyor or of the grippers is controlled correspondingly.

11. An apparatus for implementing the method as claimed in claim 1, comprising:

a circulating system which has compartments moving along a closed circulatory path (U) and to which products are fed at a transfer location (A) with their leading edge in front, wherein the circulating system is a paddle wheel which can be rotated about an axis of rotation (D) and of which the compartments have compartment bases spaced apart from the axis of rotation, and wherein the compartments open opposite to the direction of circulation at an angle relative to the radial direction, so that the leading edge of the products seen in the direction of circulation of the paddle wheel is located upstream of the trailing edge, and also comprising a gripper conveyor with a plurality of grippers, wherein the gripper conveyor is arranged relative to the circulating system such that the grippers are capable of gripping, at a receiving location (B), the trailing edges of the products introduced into the compartments of the circulating system, wherein the gripper conveyor is arranged relative to the circulating system such that the leading edge of a product during conveying between the transfer location (a) and the receiving location (b), at least until the product is gripped, is located beneath the trailing edge of the product.

12. The apparatus as claimed in claim 11, wherein the transfer location (A) and the receiving location (B) are positioned such that the leading edge of a product, during conveying through the circulating system, at least until the product is gripped, is located beneath the trailing edge of the product.

13. The apparatus as claimed in claim 11, wherein the gripper conveyor is arranged relative to the circulating system such that the trailing edge of a product, at least immediately after the product has been received, is located upstream of the leading edge of the product, as seen in the conveying direction of the gripper conveyor.

14. The apparatus as claimed in claim 11, wherein the gripper conveyor is arranged to the side of the circulating system and outside the circulating system, as seen in a plan view of the movement plane of the circulating system.

15. The apparatus as claimed in claim 11, further comprising a stripping device which is capable of pushing the products out of the compartments counter to gravitational force.

16. The apparatus as claimed in claim 15, wherein the stripping device can be displaced, in the horizontal direction, relative to the circulating system for adaptation to different product formats.

17. The apparatus as claimed in claim 11, further comprising a monitoring device for monitoring the formation of products which is fed to the circulating system, in particular for determining irregularities or defective products, and this monitoring device is capable of communicating with a control device, wherein the control device is capable of controlling the movement of the circulating system or of the gripper conveyor or of the gripper.

* * * * *